US009738951B1

(12) United States Patent
Raykhtsaum

(10) Patent No.: US 9,738,951 B1
(45) Date of Patent: Aug. 22, 2017

(54) 18K PALLADIUM AND PLATINUM CONTAINING AGE HARDENABLE WHITE GOLD ALLOY

(71) Applicant: LeachGarner, Inc., Attleboro, MA (US)

(72) Inventor: Grigory Raykhtsaum, Sharon, MA (US)

(73) Assignee: LeachGarner, Inc., Attleboro, MA (US)

( * ) Notice: Subject to any disclaimer, the term of this patent is extended or adjusted under 35 U.S.C. 154(b) by 0 days.

(21) Appl. No.: 15/086,196

(22) Filed: Mar. 31, 2016

(51) Int. Cl.
*C22C 5/02* (2006.01)
*C22F 1/14* (2006.01)

(52) U.S. Cl.
CPC . *C22C 5/02* (2013.01); *C22F 1/14* (2013.01)

(58) Field of Classification Search
CPC ..... C22C 5/02; C22F 1/14
See application file for complete search history.

(56) References Cited

U.S. PATENT DOCUMENTS 5,462,437 A * 10/1995 Prasad ..... A61K 6/026 148/430
6,787,102 B2 9/2004 Vincent

FOREIGN PATENT DOCUMENTS

DE 551798 C * 6/1932 ..... A61C 13/00
DE 19958800 A1 * 1/2001 ..... A44C 27/003
JP 09184033 A * 7/1997

OTHER PUBLICATIONS

Katja et al., English machine translation of DE19958800A1, Jan. 2001, p. 1-9.*
Kashiwagi Kozo, English machine translation of JP 09-184033A, Jul. 1997, p. 1-5.*
Smith et al., "Annealing of Precious Metals-Gold and Gold Alloys", ASM Handbook, 1991, ASM International, vol. 4, p. 1-5.*
English machine translation of DE 551798C, Jun. 1932, p. 1-4.*
English translation of DE 551798C, Jun. 1932, p. 1-8.*
Steven Henderson, Dippal Manchanda, White Gold Alloys: Colour Measurement and Grading, Gold Bulletin, 2005, pp. 55-67, vol. 38, Issue 2.
Valerio Faccenda, Pietro Oriani, Pomellato, On Nickel White Gold Alloys: Problems and Possibilities, The Santa Fe Symposium on Jewelry Manufacturing Technology, 2000, pp. 71-88.
Roy, Rushforth, Don't Let Nickel Get Under Your Skin-The European Experience, The Santa Fe Symposium on Jewelry Manufacturing Technology, 2000, pp. 281-301.

* cited by examiner

*Primary Examiner* — Roy King
*Assistant Examiner* — Caitlin Kiechle
(74) *Attorney, Agent, or Firm* — Gottlieb, Rackman & Reisman, P.C.

(57) ABSTRACT

The present invention is directed to an alloy usable for jewelry applications in which the color can be classified as white, the alloy contains both platinum and palladium and is at a metal cost or lower than that of traditional palladium-containing jewelry alloys, and is commercially age hardenable through heat treatment.

9 Claims, 1 Drawing Sheet

Chart 1.
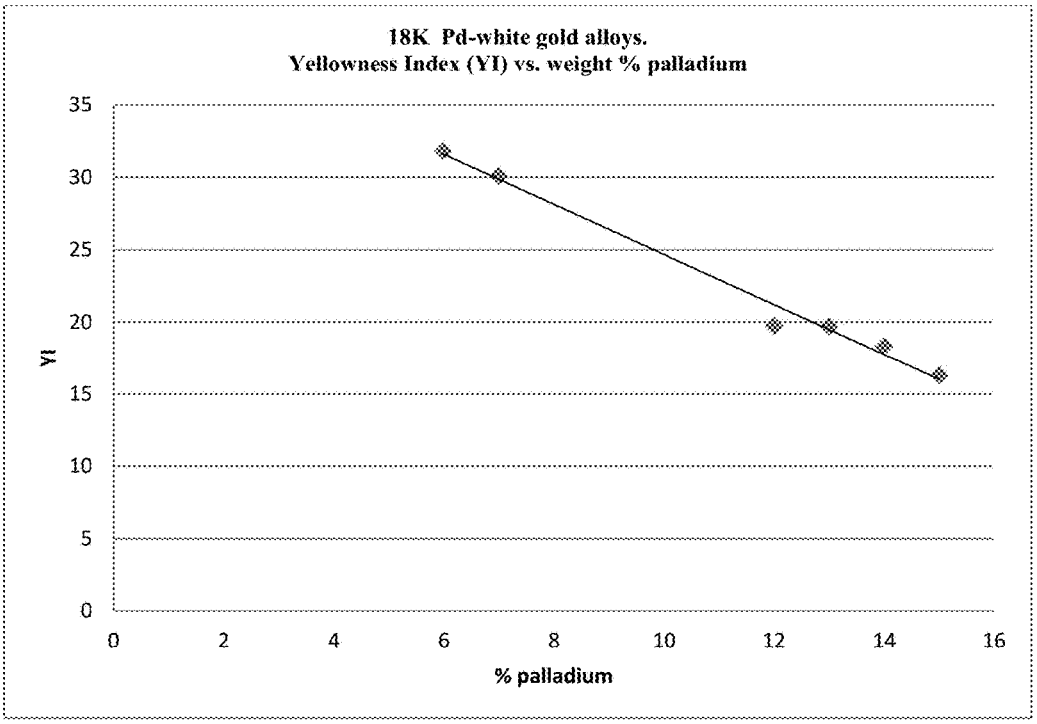

18K PALLADIUM AND PLATINUM CONTAINING AGE HARDENABLE WHITE GOLD ALLOY

BACKGROUND OF THE PRESENT INVENTION

In some metal jewelry applications, such as in preparing a ring, a lighter than usual color of gold is desirable. One technique to lighten the color is often termed "bleaching". There are two elements, nickel (Ni) and palladium (Pd), which are commonly used to bleach the color of gold when preparing white gold alloys for jewelry applications. Ni and Pd are preferably used because both metals exhibit bright gray color, and both have the same face-centered cubic crystalline structures as other major alloying elements such as gold, silver and copper.

In the past decade or so, concern has grown with regard to the inclusion of Ni in jewelry. See, for example, Roy Rushforth, "Don't Let Nickel Get Under Your Skin—The European Experience", The Santa Fe Symposium on Jewelry Manufacturing Technology, 2000, 281-301. The increased concern about nickel as a cause of allergy has led to the development of Ni-free Pd-containing white golds alloys. See, for example, Valerio Faccenda, "On Nickel White Gold Alloys: Problems And Possibilities", The Santa Fe Symposium on Jewelry Manufacturing Technology, 2000, 71-88). The increased concern about nickel as a cause of allergy has led to the development of Ni-free Pd-containing white golds alloys. By definition, 18 karat gold alloys must contain 75% gold by weight (w %) minimum to be considered 18 karat, leaving only 25 w % for all other elements, including other major elements such as silver (Ag), copper (Cu) and, in the case of white gold, Pd. In Ni-free, Pd-containing alloys, Pd tends to be in the approximate range of 6 w %-15 w %. The increasing price of precious metals including Pd makes it desirable for Ni-free white gold alloys to contain as little Pd as possible while still retaining the color and durability benefits of Pd-containing white gold alloys. However, a too-limited percentage of Pd, especially when combined with the elimination of Ni in the alloy, leads to the deterioration of the white color overall.

The whiteness of the color of gold alloys can be graded using the yellowness index (YI) as described in "White Gold Alloys: Colour Measurement and Grading" by Steven Henderson and Dippal Manchanda in Gold Bulletin, 2005, vol. 38, issue 2, pp. 55-67. According to this reference there are three grades of alloys which can be considered white in color:

TABLE 1

| Grade: | Whiteness | YI | Rhodium plating |
|---|---|---|---|
| Grade 1: | Good White | YI < 19.0 | Not necessary |
| Grade 2: | Reasonable White | 19.0 < YI < 24.5 | Optional |
| Grade 3: | Off-White | 24.5 < YI < 32.0 | Recommended |

Examples:

One commercially available 18K alloy that contains 15% palladium shows a good white color with YI=16.3 as listed in Table 2.

TABLE 2

| Alloy | % Pd | YI |
|---|---|---|
| Commercial | 15 | 16.3 |
| Vincent, Table I, Alloy 1 | 14 | 18.3 |
| Vincent, Table I, Alloy 5 | 13 | 19.7 |
| Vincent, Table I, Alloy 13 | 12 | 19.7 |
| Vincent, Table II, Alloy 4 | 7 | 30.1 |
| Vincent, Table II, Alloy 12 | 6 | 31.8 |

U.S. Pat. No. 6,787,102 to Vincent ("Vincent") teaches the formation of various alloys. Table 2 also lists YI for some of these alloys.

For comparison, a commercially available 18k yellow alloy containing no palladium has YI=48.5.

Alloys with YI>32.0 cannot be called white.

Further, the whiteness in some of the alloys of Vincent, particularly the alloy with 7% palladium shown in Table 2, is close to the borderline in what can be classified as white. This can be a concern because color properties of an alloy may vary from batch to batch due to a variety of factors, and when a color is close to a border, at times the color variability may cause a particular formulation to fall outside the white range. As a result, it is desirable to form an alloy which provides better assurance of being considered white and meets other characteristics of hardenability and cost while remaining nickel free.

Age hardening is beneficial because such alloys can be easily worked and formed in the annealed condition into the jewelry article, and then the finished jewelry article can be age hardened. Age hardening of jewelry applications shows improved durability and polish. Age hardening also allows for the manufacturing of light weight, thin walled, and reduced cross section jewelry articles without compromising the strength and durability. This process also provides additional savings on the material cost.

BRIEF DESCRIPTION OF THE PRESENT INVENTION

The present invention is directed to an alloy usable for jewelry applications in which the color can be classified as white, the alloy contains both platinum and palladium and is at a metal cost at or lower than that of traditional palladium-containing jewelry alloys, and is commercially age hardenable through heat treatment.

DESCRIPTION OF THE FIGURES

FIG. 1 shows a chart, Chart 1, detailing the 18K Pd-white gold alloy relationship between Yellowness Index (YI) and weight % palladium.

DETAILED DESCRIPTION OF THE PRESENT INVENTION

There is a need in the industry to provide 18K nickel-free palladium containing gold alloy of white color and having commercially adequate age hardening characteristics.

Based on the data shown in Table 2 the values of YI vs. palladium content are plotted in FIG. 1, Chart 1. According to the chart, an alloy containing 10% palladium is expected to show a YI value around 25. In fact, our four experimental alloys with 10% palladium show the variation of yellowness index YI within 25 -26 range—see Table 3. Alloys 1-4 are fairly soft in the annealed condition exhibiting Vickers hardness within the 120-150 range; none of them can be age hardened by a heat treatment.

We find that palladium content in 18K alloy formulations should be below 7% in order to show noticeable age hardening. One example is alloy 5 in Table 3. The Vickers hardness of this alloy in the annealed condition is about 160, and can be increased up to 200 by a heat treatment at 700° F. for about 1 hour. The value of YI for this alloy is about 28.5.

TABLE 3

| Experimental Alloy | Au | Ag | Pd | Pt | Cu | Zn | YI |
|---|---|---|---|---|---|---|---|
| 1 | 75 | 5 | 10 | | 5 | | 16 |
| 2 | 75 | 10 | 10 | | 5 | | 25 |
| 3 | 75 | 5 | 10 | | 10 | | 26 |
| 4 | 75 | 5 | 10 | | 5 | 5 | 26 |
| 5 | 75 | 5 | 7 | | 10.5 | 2.5 | 29 |
| 6 | 75 | 10 | 7 | 1.5 | 5 | 1.5 | 27 |

Such alloys as experimental alloy 5 in Table 3 show inconsistent age hardening as the small temperature variations affect the degree of hardening. Experimental alloy 6 in Table 3 can be age hardened more consistently by the addition of 1.5% platinum. This alloy has an improved white color with YI value of 27 (closer to those of 10% palladium alloys); and can be age hardened from 140 Vickers in the annealing condition up to 210 Vickers by heat treatment at 750° F. for about 1 hour. The total palladium and platinum intrinsic value is less than that of 10% palladium white alloys, and therefore, this alloy is less expensive than 10% palladium containing alloys.

It is not unusual for a production furnace, when set up at 700° F., to have a variation in temperature of ±20° F. over time. An alloy such as experimental alloy 5 shows a narrow age hardening temperature range so that ±20° F. variation in the furnace significantly affects the degree of hardening as material is not exposed to 700° F. all the time. Increasing the aging time may lead to material deterioration due to over-aging. Adding 1.5% Pt broadens the aging temperature range to about ±50° F., and therefore improves the consistency of the hardening procedure, and in addition, increases the aged hardness by about 10 Vickers—from 200 in alloy 5 to 210 Vickers in alloy 6.

Typical properties of alloys 1-4 are listed below:
- Density: 168.3 dwt/in$^3$ (16.0 g/cm$^3$)
- Annealed hardness: 120 Vickers
- Aged hardness: alloy cannot be age hardened.
- Annealing temperature: 1250° F. (675° C.)
- Melting range: 1895° F.-2055° F. (1035° C.-1125° C.)

Typical properties of alloy 5 are listed below:
- Density: 162.5 dwt/in$^3$ (15.4 g/cm$^3$)
- Annealed hardness: 160 Vickers
- Aged hardness: 190 Vickers
- Annealing temperature: 1250° F. (675° C.)
- Aging temperature: 750° F. (400° C.)
- Melting range: 1645° F.-1725° F. (895° C.-940° C.)

Alloy 6 in Table 3 has a preferred composition. The properties of this alloy are:
- Density: 168.8 dwt/in$^3$ (16.0 g/cm$^3$)
- Annealed hardness: 155 Vickers
- Aged hardness: 210 Vickers
- Annealing temperature: 1250° F. (675° C.)
- Aging temperature: 750° F. (400° C.)
- Melting range: 1840° F.-1985° F. (1005° C.-1085° C.).

Suggested alloy compositional range:
- Gold: 74.5%-75.5%
- Silver: 8%-12%
- Palladium: 6.5%-7.5%
- Platinum: 0.5%-3%
- Zinc: 0.5%-5%
- Copper: balance Possible small additions:
- Lithium (de-oxidizer): 0%-0.03%
- Cobalt (grain refiner): 0%-0.5%
- Silicon (de-oxidizer): 0%-0.1%
- Boron (improves metal fluidity while casting): 0%-0.03%

The invention claimed is:

1. An age hardenable alloy composition suitable for jewelry consisting of:
- 74.5% to 75.5% gold,
- 8% to 12% silver,
- 6.5% to 7.5% palladium,
- 0.5% to 3% platinum,
- 1.0% to 5% zinc,
- up to 9.5% copper; and at least one selected from the group consisting of:
- up to 0.03% lithium,
- up to 0.5% cobalt,
- up to 0.1% silicon, and
- up to 0.03% boron;
- wherein all values are in w % and said composition exhibits a color which is white and shows age hardening characteristics including an annealed hardness of about 140 Vickers, and an aged hardness of up to 210 Vickers.

2. The composition of claim 1, wherein said composition consists of no more than one from the group consisting of lithium, cobalt, silicon, and boron.

3. The composition of claim 1, wherein said composition has a YI value of about 27.

4. The composition of claim 1, wherein platinum is limited to the range of 1 w % to 2 w %.

5. The composition of claim 4, wherein said composition consists of no more than one from the group consisting of lithium, cobalt, silicon, and boron.

6. The composition of claim 4, wherein said composition has a YI value of about 27.

7. The composition of claim 1, wherein platinum is limited to the range of 1 w % to 1.5 w %.

8. The composition of claim 7, wherein said composition consists of no more than one from the group consisting of lithium, cobalt, silicon, and boron.

9. The composition of claim 7, wherein said composition has a YI value of about 27.

* * * * *